United States Patent [19]

Dettbarn

[11] Patent Number: 5,003,742

[45] Date of Patent: Apr. 2, 1991

[54] INSULATED WALL ASSEMBLY

[76] Inventor: Richard Dettbarn, 7803 G-35 Street S.E., Calgary, Alberta, Canada, T2C 1V3

[21] Appl. No.: 135,641

[22] Filed: Dec. 21, 1987

[30] Foreign Application Priority Data

Jun. 1, 1987 [CA] Canada ..... 538453

[51] Int. Cl.[5] ..... E04B 7/02; E04B 1/76; E04C 2/20

[52] U.S. Cl. ..... 52/282; 52/284; 52/309.8; 52/404; 52/763; 52/729

[58] Field of Search ..... 52/404, 309.6, 309.8, 52/309.11, 282, 309.4, 309.7, 763, 729, 284

[56] References Cited

U.S. PATENT DOCUMENTS

| | | | |
|---|---|---|---|
| 2,128,540 | 8/1938 | Rocque | 52/404 |
| 3,295,278 | 1/1967 | Muhm | 52/309.11 |
| 4,288,962 | 9/1981 | Kavanaugh | 52/309.11 |
| 4,443,988 | 4/1984 | Coutu, Sr. | 52/309.2 |
| 4,641,468 | 2/1987 | Slater | 52/309.4 |
| 4,674,250 | 6/1987 | Altizer | 52/309.4 |

FOREIGN PATENT DOCUMENTS

| | | | |
|---|---|---|---|
| 815219 | 6/1969 | Canada . | |
| 1116371 | 1/1982 | Canada . | |
| 190818 | 8/1986 | European Pat. Off. | 52/404 |
| 3237595 | 4/1984 | Fed. Rep. of Germany | 52/404 |

*Primary Examiner*—John E. Murtagh
*Attorney, Agent, or Firm*—William R. Hinds

[57] ABSTRACT

An insulated wall assembly which combines strength with good insulating qualities includes spaced apart, elongated wooden posts, which are I-shaped in cross section; and elongated rigid foam plastic panels extending between adjacent posts, the panels being generally cruciform in cross section so that projections on the lateral edges thereof extend into the recesses of the posts while the front and rear or outer and inner surfaces of the panels are in the same planes as the outer and inner surfaces of the posts. Alternatively, the panels are parallelepipedic blocks with longitudinally extending, rectangular grooves in the sides thereof for receiving splines, which connect the blocks to rectangular, grooved insulating inserts in the posts.

6 Claims, 2 Drawing Sheets

INSULATED WALL ASSEMBLY

BACKGROUND OF THE INVENTION

This invention relates to a wall assembly, and in particular to an insulated wall assembly.

Canadian Patents Nos. 1,116,371, issued to Truefoam Canada Limited on Jan. 19, 1982 and 1,124,482, issued to Cano Thermo Systems Inc. on June 1, 1982 and applicant's Canadian patent application Ser. No. 472135-7, filed Jan. 15, 1985 describe insulated wall assemblies. The earlier structures permit the construction of well insulated walls, but, in general require a large number of different parts or components, particularly when forming corners.

An object of the present invention is to provide a relatively simple insulated wall assembly, which while structurally strong, requires few basic, lightweight components.

Another object of the invention is to provide an assembly of the above described type which is at least approximately equal to earlier structures in terms of insulating ability and the prevention of thermal bridging.

BRIEF SUMMARY OF THE INVENTION

Accordingly, the present invention relates to an insulated wall assembly comprising spaced apart wooden post means of I-shaped cross section and insulating panel means extending between and interconnecting said post means, said panel means including lateral projections for insertion into the recesses in said post means and front and rear surfaces coplanar with the front and rear surfaces of the post means in the assembled condition.

BRIEF DESCRIPTION OF THE DRAWINGS

The invention will be described in greater detail with reference to the accompanying drawings, which illustrate preferred embodiments of the invention, and wherein.

DESCRIPTION OF THE PREFERRED EMBODIMENT(S)

Figure 1:
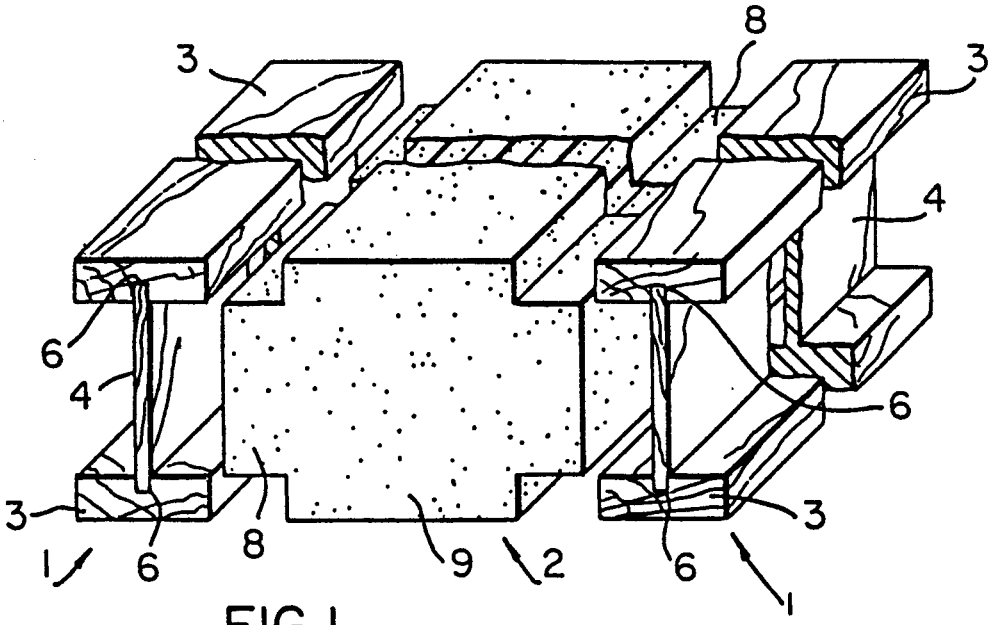
FIG. 1 is an exploded, perspective view from one end of a first embodiment of a wall assembly in accordance with the present invention.

Referring to FIG. 1, the basic elements of a wall assembly in accordance with the present invention include an I-beam type or I-shaped post generally indicated at 1 and a rigid foam plastic insulating panel generally indicated at 2. The post 1 does not embody a new structure, i.e. posts of this type are known. However, it is believed that such posts have not been employed in the manner proposed herein. Each post 1 is defined by a pair of spaced apart 2"×6" spruce planks or boards 3 which are interconnected by a narrow wooden web 4 of plywood. The web 4 extends into rectangular, longitudinally extending grooves 6 in the boards 3. The web 4 is glued to the boards 3.

The boards 3 and web 4 define rectangular recesses for receiving lateral projections 8 on the insulating panel 2. The panel 2 is defined by a rigid foam plastic body 9 of cruciform cross section. The foam plastic is expanded polystyrene. By using a cruciform cross section with the lateral projections 8, the body 9 can be used to interconnect adjacent posts 1, the projections 8 extending into aligned recesses in the posts.

Figure 2:
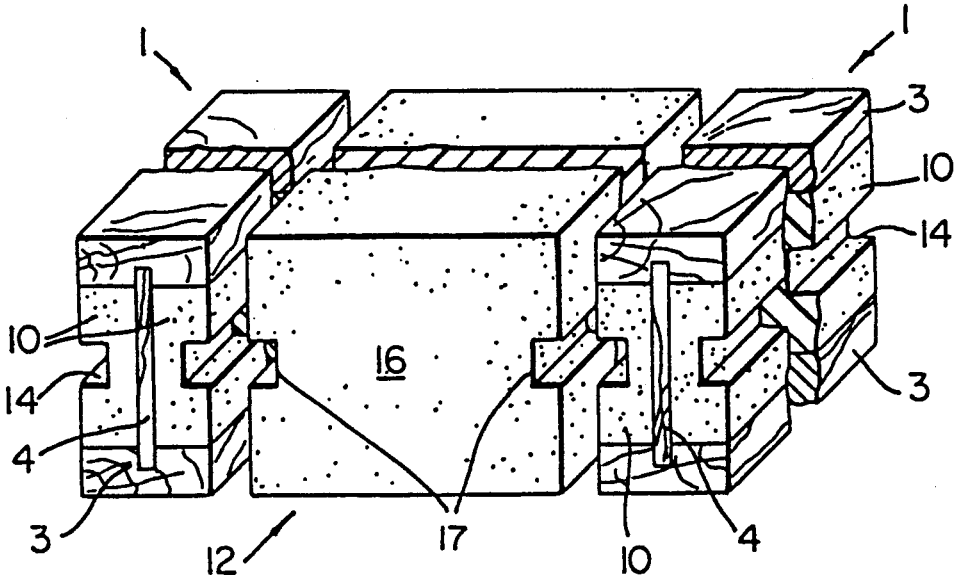
FIG. 2 is an exploded, perspective view of a second embodiment of the wall assembly of the present invention.
Figure 3:
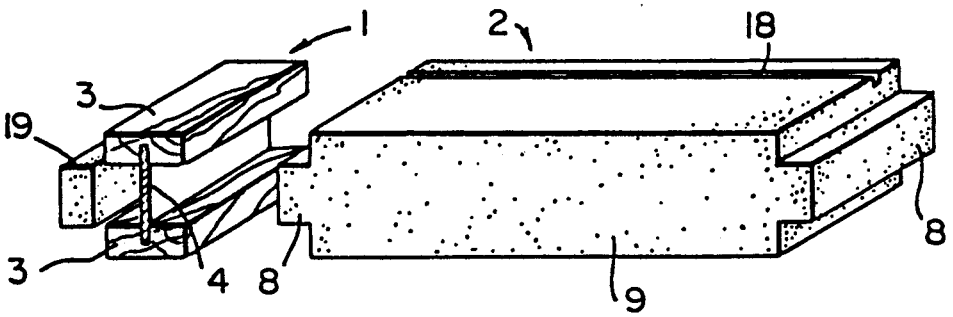
FIG. 3 an exploded, perspective view of all of the elements required to form a wall assembly of the type shown in FIG. 1.
Figure 4:
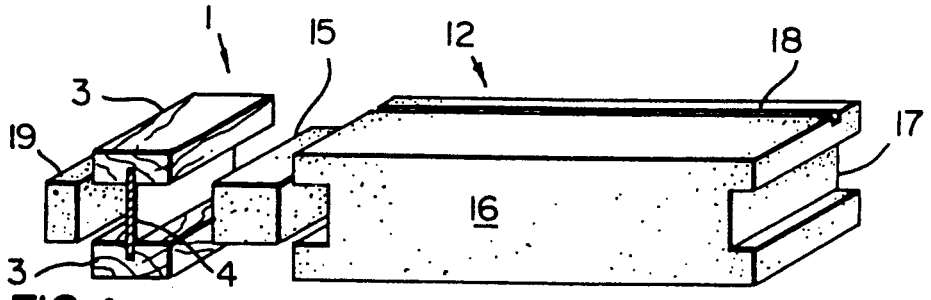
FIG. 4 is an exploded, perspective view of all of the elements required to form a modified wall assembly of a type similar to that shown in FIG. 2.
Figure 6:
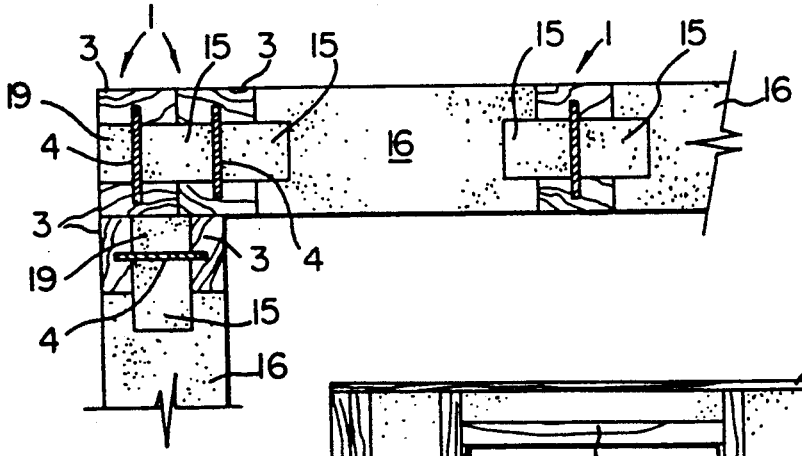
FIG. 6 is a plan view of one corner of a wall assembly constructed with the elements of FIG. 4.

Referring to FIG. 2 a second embodiment of the invention includes the posts 1, which have been modified to include insulating inserts 10, and a rigid foam plastic panel generally indicated at 12. The inserts 10 are secured with the posts 1 and include rectangular, longitudinally extending grooves 14 in the centre of the outer, side edge thereof for receiving a rigid foam plastic spline generally of the type shown at 15 (FIGS. 4 and 6). The panel 12 is basically a rectangular parallelepipedic block or body 16 with rectangular, longitudinally extending grooves 17 in the centre of each side thereof for receiving splines 15. As shown in FIGS. 3 and 4, the panel 9 or 16 can include a transversely extending groove 18 for carrying electrical wires.

A corner in a wall assembly produced using the posts 1 and panels 2 of FIG. 1 requires only one additional element, namely a rectangular insulating plug 19 (FIG. 3), which is inserted into an outer groove in the post 1. By the same token, the posts 1 and panels 12 of FIG. 2 require only a plug for completing a corner structure.

Figure 5:
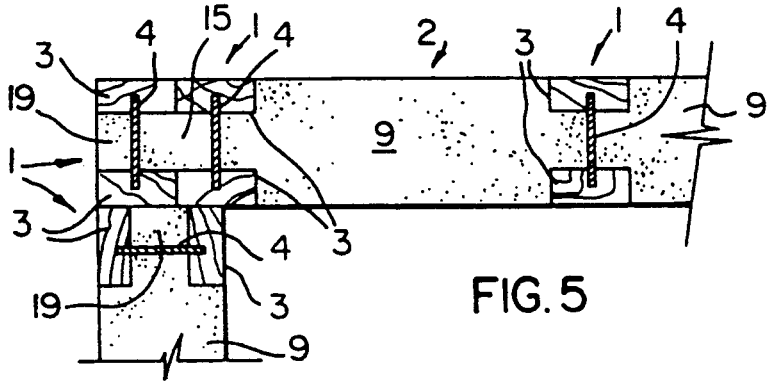
FIG. 5 is a plan view of one corner of a wall assembly constructed with the elements of FIG. 3.

With reference to FIG. 5, a wall assembly constructed with the elements of FIGS. 1 and 3 includes posts 1 and panels 2 which are strung together to form walls of the desired length.

A plug 19 is inserted into each end of each wall to complete the wall. In each case, the plug 19 adds insulation and provides a smooth end. When forming a corner a spline 15, a second end post 1 and a plug 19 are added to a first wall, and the post 1 of the second perpendicular wall abuts the inner surface of the outer post 1 and a portion of the inner post 1 of such first wall. As shown in FIG. 6, essentially the same elements are used to form a wall assembly with a corner when employing the elements of FIG. 4, and analogous elements are used when employing the elements of FIG. 2.

Figure 7:
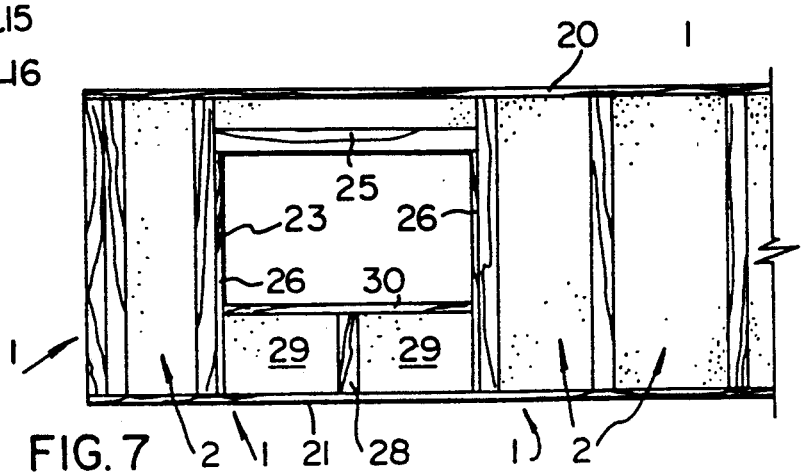
FIG. 7 is a side elevation view of a wall assembly of the type shown in FIG. 5 or 6.

A complete wall (FIG. 7) is produced using a top plate 20, a bottom plate 21, posts 1 and panels 2. In order to form a window opening 23, a lintel 25 is inserted between two posts 1. The lintel 25 is supported by end posts 26.

A short post 28 and short panels 29 are provided beneath the lintel, and a sill 30 is attached to the tops of the post 28 and the panels 29.

Thus, there has been described a relatively simple wall assembly, which is formed using a small number of elements, and which is structurally sound.

What is claimed is:

1. An insulated wall assembly comprising spaced apart wooden post means of I-shaped cross section, each post means having front and rear surfaces and opposing recesses therebetween; and insulating panel means extending between and interconnecting said post means, said panel means including lateral projections for insertion into the recesses in said post means and front and rear surfaces coplanar with the front and rear surfaces of the post means in the assembled condition.

2. A wall assembly according to claim 1, wherein said panel means is substantially cruciform in cross section, and including lateral projections for insertion into the recesses in the post means.

3. A wall assembly according to claim 1, wherein at least one post means defines each end of the assembly, the assembly including plug means in each post means at each outer end of the assembly.

4. A wall assembly according to claim 2, wherein at least one post means defines each end of the assembly, the assembly including plug means in each post means at each other end of the assembly.

5. A wall assembly according to claim 1, wherein a pair of interconnected post means define one end of one wall, and a single post means defines one end of a second wall perpendicular to and abutting one surface of the pair of post means for defining a corner.

6. A wall assembly according to claim 2, wherein a pair of interconnected post means define one end of one wall, and a single post means defines one end of a second wall perpendicular to and abutting one surface of the pair of post means for defining a corner.

* * * * *